US011130032B2

(12) United States Patent
Huth

(10) Patent No.: US 11,130,032 B2
(45) Date of Patent: Sep. 28, 2021

(54) SOCCER TRAINER NET

(71) Applicant: Implus Footcare, LLC, Durham, NC (US)

(72) Inventor: Richard Raymond Huth, Encinitas, CA (US)

(73) Assignee: Implus Footcare, LLC, Durham, NC (US)

( * ) Notice: Subject to any disclaimer, the term of this patent is extended or adjusted under 35 U.S.C. 154(b) by 0 days.

(21) Appl. No.: 16/700,136

(22) Filed: Dec. 2, 2019

(65) Prior Publication Data

US 2021/0162286 A1 Jun. 3, 2021

(51) Int. Cl.
*A63B 69/00* (2006.01)
*A63B 63/00* (2006.01)

(52) U.S. Cl.
CPC ..... *A63B 63/004* (2013.01); *A63B 69/00* (2013.01); *A63B 2243/0025* (2013.01)

(58) Field of Classification Search
CPC ..... A63B 63/004; A63B 69/002; A63B 69/00; A63B 63/00; A63B 69/0097
USPC ..... 473/431, 446, 197; D21/780, 788, 790
See application file for complete search history.

(56) References Cited

U.S. PATENT DOCUMENTS 2,992,002 A 7/1961 Bingham, Jr.
3,195,898 A * 7/1965 Respini ..... A63B 63/00 473/197
3,435,487 A * 4/1969 Mazzei ..... F16C 7/04 473/493
4,274,632 A * 6/1981 Jacobs ..... A63B 61/02 473/492
4,489,941 A 12/1984 Shieh
4,717,157 A * 1/1988 Smith ..... A63B 61/003 473/494

(Continued)

FOREIGN PATENT DOCUMENTS

EP 0014133 8/1980
GB 1069207 5/1967

(Continued)

OTHER PUBLICATIONS

"Elastic Bungee", Give Go Rebounder, 5 pages (available at least as early as Sep. 9, 2019).

(Continued)

*Primary Examiner* — Mitra Aryanpour
(74) *Attorney, Agent, or Firm* — Kilpatrick Townsend & Stockton LLP

(57) ABSTRACT

A soccer training net includes a frame having an upper portion and a lower portion, a generally rectangular net having a bottom edge and a top edge, and a lower elastic member having a first end, a second end, and a medial section that extends between the ends. The medial section is coupled with and extends along the bottom edge of the net. Each end is coupled the lower portion of the frame. Upper coupling members extend between and are coupled with the upper portion of the frame and corners of the top edge of the net. The frame does not include a member that extends along the bottom edge of the net such that the medial section of the lower elastic member and the bottom edge of the net are suspended between the sides of the lower portion of the frame.

20 Claims, 7 Drawing Sheets

(56) References Cited

U.S. PATENT DOCUMENTS 5,393,069 A * 2/1995 Taylor ..... A63B 61/02 473/416
5,394,927 A * 3/1995 Huebner ..... A63B 71/022 160/327
5,562,288 A * 10/1996 Erkebaev ..... A63B 69/0097 473/197
5,615,889 A 4/1997 Long
5,810,363 A * 9/1998 Saunders ..... F41J 1/00 473/197
5,833,234 A 11/1998 Vavala et al.
5,857,679 A 1/1999 Ringe et al.
5,951,415 A * 9/1999 Gates ..... A63B 63/004 473/478
6,021,702 A * 2/2000 Rexroad ..... E04G 5/12 473/493
6,213,469 B1 4/2001 Lucio et al.
6,287,220 B1 9/2001 Caruso
6,299,544 B1 10/2001 Schwarzler et al.
6,357,750 B1 3/2002 Lievens
6,585,610 B2 7/2003 Sompolinsky
6,659,892 B2 12/2003 Lytle et al.
6,739,988 B2 5/2004 Jensen et al.
6,846,253 B1 1/2005 Szwalek
D503,448 S 3/2005 Isom
6,880,828 B2 4/2005 Liao
6,893,364 B1 5/2005 Grunfeld
D517,620 S 3/2006 Mazloompour
D531,684 S * 11/2006 Bouffard ..... D21/698
7,223,187 B1 5/2007 Bouffard et al.
7,249,767 B1 7/2007 Gorton
7,264,245 B2 9/2007 Cho
D562,418 S 2/2008 Sifrit
7,455,603 B2 11/2008 Bouffard et al.
7,462,114 B2 12/2008 Moller, Jr.
D584,368 S 1/2009 Stoewhass
D585,949 S 2/2009 Gaudin et al.
7,543,821 B2 6/2009 Winningham et al.
7,600,759 B2 10/2009 Crawley et al.
7,651,098 B2 1/2010 Cho
D623,246 S 9/2010 Nozato
7,828,296 B2 11/2010 Crawley et al.
7,909,330 B2 3/2011 Domjen
7,914,402 B2 3/2011 Gaudin et al.
8,043,172 B2 10/2011 Campanaro et al.
D649,209 S 11/2011 Silvi
8,177,651 B2 5/2012 Curry
8,246,496 B2 8/2012 Holland et al.
D689,570 S 9/2013 Adema
8,579,737 B2 11/2013 Holland et al.
8,590,901 B2 11/2013 Goldwitz
8,647,221 B1 2/2014 Hochberg
8,651,979 B2 2/2014 Chen
8,651,980 B2 2/2014 Jackson
D703,774 S 4/2014 Riccardella et al.
8,758,173 B2 6/2014 Goodman
D709,970 S * 7/2014 Holland ..... D21/705
8,932,157 B2 1/2015 Wright
D731,013 S 6/2015 Jackowiak
9,162,127 B2 10/2015 Holland et al.
9,227,123 B2 1/2016 Debolt et al.
9,227,126 B2 1/2016 Christgau et al.
9,289,637 B2 3/2016 Publicover et al.
9,339,711 B2 5/2016 Goodman
9,452,337 B2 9/2016 Littman et al.
9,533,208 B2 1/2017 Wright
D779,602 S 2/2017 Hochberg
9,573,033 B2 2/2017 Surbrook
9,586,117 B2 3/2017 Freund
D789,466 S 6/2017 Cho et al.
D805,591 S 12/2017 Miller et al.
D806,812 S 1/2018 Adams
D809,076 S 1/2018 Yu et al.
9,987,536 B2 6/2018 Nash
9,999,816 B2 6/2018 Holland et al.
D833,547 S 11/2018 Weber
10,130,859 B1 11/2018 Riley
10,166,453 B1 1/2019 Dickerson
2002/0013187 A1 1/2002 Grunfeld
2002/0183127 A1 12/2002 Cho
2004/0176193 A1 9/2004 Valliquette
2004/0235589 A1 11/2004 Wedgbury
2005/0049089 A1* 3/2005 Pakieser ..... A63B 69/002 473/446
2005/0189719 A1 9/2005 Goldwitz
2005/0192125 A1 9/2005 Valliquette
2005/0275168 A1 12/2005 Kegevic et al.
2007/0090601 A1 4/2007 Liao
2007/0235942 A1 10/2007 Cho
2007/0281807 A1 12/2007 Cho
2008/0067751 A1 3/2008 Hunt
2011/0059815 A1 3/2011 Jones
2011/0092321 A1 4/2011 Szaro et al.
2014/0235374 A1 8/2014 Armell
2014/0296002 A1 10/2014 Luo
2016/0016060 A1* 1/2016 Goldwitz ..... A63B 69/00 473/446
2016/0089587 A1 3/2016 Cowan
2016/0199718 A1 7/2016 Holland et al.
2016/0310774 A1 10/2016 Publicover et al.
2016/0339319 A1 11/2016 Weber
2017/0144046 A1 5/2017 Weber
2017/0157485 A1 6/2017 Esser
2017/0173435 A1 6/2017 Freund
2017/0189773 A1 7/2017 Cho
2017/0203176 A1 7/2017 Moros
2017/0259148 A1 9/2017 Mazloompour

FOREIGN PATENT DOCUMENTS

WO 2006025752 3/2006
WO 2017123979 7/2017
WO 2018085919 5/2018

OTHER PUBLICATIONS

"M-Station by Munisports", (available at least as early as Sep. 9, 2019).
"Soccer Trainer by Tekk", (available at least as early as Sep. 9, 2019).
"Soccer Wave", (available at least as early as Sep. 9, 2019).
Application No. PCT/US2020/048381 , International Search Report and Written Opinion, dated Nov. 27, 2020, 11 pages.
International Application No. PCT/US2020/062754, International Search Report and Written Opinion dated Mar. 22, 2021, 15 pages.

* cited by examiner

SOCCER TRAINER NET

BACKGROUND OF THE INVENTION

In order to keep a bottom edge of a net near the ground, conventional soccer training nets often employ the use of a bottom front bar that extends along the bottom edge of the net. However, use of such a rigid member may disrupt the path of the ball into the net and may diminish the ability of the training net to provide a consistent rebound. Other conventional nets utilize ties or other tensioning mechanisms to secure the net to sides of a frame, while leaving the bottom edge of the net unconstrained. Such designs often provide reduced rebounding abilities, as the unconstrained bottom edge causes the net to absorb excess energy from the ball, rather than redirecting more of the energy to the rebound of the ball. Improvements in existing soccer training nets are desired.

BRIEF SUMMARY OF THE INVENTION

Embodiments of the present invention are directed to improved soccer training nets that provide increased bounce-back or rebound capabilities. Embodiments of the invention achieve the increased bounce-back by coupling a bottom edge of the net to the frame using an elastic member that extends along all or a substantial portion of the length of the bottom edge of the net. In some embodiments, the training nets described herein may include two nets. For example, one net may be angled upward for helping users practice receiving aerial balls while a second net may be angled downward to help users practice receiving ground balls.

According to one embodiment, a soccer training net is provided. The soccer training net may include a frame having an upper portion and a lower portion, a generally rectangular net having a bottom edge and a top edge, and a lower elastic member having a first end, a second end, and a medial section that extends between the first end and the second end. The medial section may be coupled with and extend along the bottom edge of the net. The first end of the lower elastic member may be coupled with a first side of the lower portion of the frame. The second end of the lower elastic member may be coupled with a second side of the lower portion of the frame. The soccer training net may also include a first upper coupling member that extends between and is coupled with the upper portion of the frame and a first corner of the top edge of the net and a second upper coupling member that extends between and is coupled with the upper portion of the frame and a second corner of the top edge of the net. The frame does not include a member that extends proximate and parallel with the bottom edge of the net such that the medial section of the lower elastic member and the bottom edge of the net are suspended between the first side and the second side of the lower portion of the frame.

In some embodiments, the bottom edge of the net may define a channel that receives the medial section of the lower elastic member. In some embodiments, the lower elastic member has a length in its unstretched or equilibrium state that is less than a length of the bottom edge of the net. In some embodiments, each of the first end and the second end of the lower elastic member may include a loop that is configured to couple with a corresponding attachment member on the lower portion of the net. The lower elastic member may extend along an entire length of the bottom edge of the net. In some embodiments, the soccer training net may also include an additional net that is coupled with the frame using a plurality of elastic members. In some embodiments, an outward facing surface of the additional net may be angled downward.

In some embodiments, each of the first end and the second end of the lower elastic member may be coupled with the lower support via attachment loops. In some embodiments, the attachment loops are secured to a binding of the net. In some embodiments, each upper coupling member may include an elastic member that has a loop that extends between an end of the upper support and one upper attachment point. In some embodiments, the net is angled upward. In some embodiments, each upper elastic member may include a connector that is configured to couple with a corresponding mating feature of an upper support of the upper portion of the frame. In some embodiments, the corresponding mating features may each include a flanged protrusion, while the connector may define a keyhole slot that is configured to receive and retain the flanged protrusion.

In some embodiments, a left upper support is coupled with a rear end of a left lower support and a right upper support is coupled with a rear end of a right lower support. In other embodiments, the left upper support is coupled with a medial portion of the left lower support and the right upper support is coupled with a medial portion of the right lower support. In some embodiments, the soccer training net may include an additional left upper support, an additional right upper support, and an additional net that is secured to the frame using attachment mating features on each of the additional left upper support, the additional right upper support, the left lower support, and the right lower support. In some embodiments, the net or the additional net is angled downward. In some embodiments, the soccer training net includes a first reinforcement member that is coupled between the left upper support and the left lower support and a second reinforcement member that is coupled between the right upper support and the right lower support.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a set of parentheses containing a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to soccer training nets. The soccer nets of the present invention secure a bottom edge of the net to a frame using an elastic member (such as a bungee) that is coupled with and extends along all or a substantial portion of the length of the bottom edge of the net. By securing the bottom edge of the net to the frame in such a manner and by ensuring that the elastic member is pulled tight, the bottom edge of the net is pulled down toward the ground and eliminates the gap between the net and the ground. The design also helps provide more elasticity and bounce back when the ball is kicked into the net giving the soccer training nets more spring back (rebound force) than conventional rebounders. Additionally, embodiments of the soccer training nets may eliminate the use of a bottom front bar that is often found in conventional soccer training nets. As a result, the soccer training nets disclosed herein may provide stronger and more consistent rebounding abilities.

While discussed largely in relation to soccer training nets, it will be appreciated that embodiments of the invention are not so limited and that the techniques described herein may be used in other applications. For example, the securement techniques of the nets disclosed herein may be implemented in rebounders for baseball, lacrosse, and/or other sports.

Figure 1:
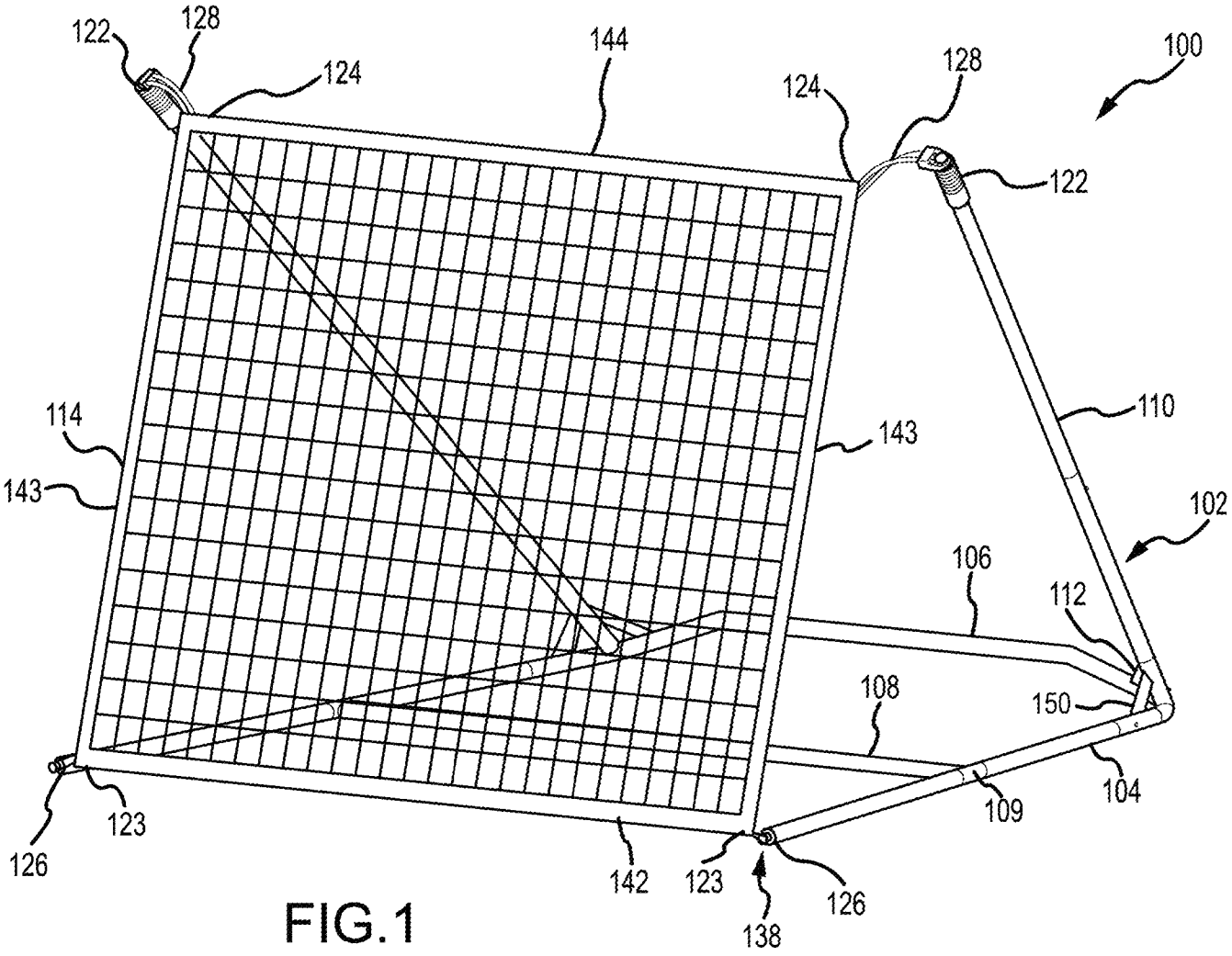
FIG. 1 illustrates a soccer training net according to embodiments.

Turning now to FIG. 1, one embodiment of a training net 100 is illustrated. Training net 100 may include a frame 102 that is configured to couple with and support a net 114. The frame 102 may include a lower portion that includes a number of frame supports that provide a solid base for the net 114. For example, the frame 102 may include two or more lateral supports 104 that form sides of the lower portion of the frame 102. Each lateral support 104 may be formed as a unitary piece, or, alternatively, each lateral support 104 may be formed of multiple pieces that are secured together to form the lateral support 104.

The lateral supports 104 may be connected to each other via one or more bracing members. For example, as illustrated a rear bracing member 106 may extend between the lateral supports 104 and couple rear ends of the lateral supports 104 together (as discussed in more detail below). The rear bracing member 106 may be formed as a unitary piece or alternatively may be formed of multiple pieces that are secured together to form the rear bracing member 106. In some embodiments, a portion of the rear bracing member 106 may be elevated relative to the lateral supports 104. For example, a portion of the rear bracing member 106 may be bent and/or otherwise angled such that a section of the rear bracing member 106 (such as a medial section) may be slightly elevated relative to the lateral support 104. This may enable the training net 100 to withstand harder kicks, as the training net 100 may be able to rock back slightly onto the elevated section of the rear bracing member 106 to absorb a portion of the force associated with a kicked ball.

In some embodiments, one or more medial bracing members 108 may also be included that extend between the lateral supports 104. For example, as shown in FIG. 1, one medial bracing member 108 extends between the lateral supports 104 and helps prevent the lateral supports 104 from moving inward or outward relative to one another. The medial bracing member 108 may be formed as a unitary piece or alternatively may be formed of multiple pieces that are secured together to form the medial bracing member 108. In the illustrated embodiment, a cuff 109 is provided each end of the medial bracing member 108. The cuffs 109 extend at least partially around the lateral supports 104 to connect the medial bracing member 108 to the lateral supports 104.

While shown with two lateral supports 104, one rear bracing member 106, and one medial bracing member 108, it will be appreciated that other numbers and/or arrangements of supports and/or bracing members may be utilized to form a lower portion of a frame 102.

The frame 102 may also include an upper portion that extends from the lower portion and that helps define an upper height of the training net 100. The upper portion of the frame 102 may include at least one upper support 110 that extends upward from the lower portion of the frame 102. As illustrated, the frame 102 includes two upper supports 110, with one of the upper supports 110 extending upward from each of the lateral supports 104. In other embodiments, one or more upper supports 110 may extend upward from a bracing member. In some embodiments, the upper supports 110 may extend upward from the lateral support 104 (or other structure of the lower portion of the frame 102) at an angle. For example, the upper supports 110 may project forward from a rear portion of the lateral supports 104 such that an upper end of each upper support 110 points forward and upward. The positioning of a forwardmost end of each upper support 110 relative to a forwardmost end of the lateral supports 104 may drive an angle of the net 114 once the net 114 is coupled with the frame 102. For example, the less the horizontal distance is between the forwardmost ends of the lateral supports 104 and the upper supports 110, the more vertically the net 114 will be relative to the ground, while greater horizontal distances result in the net 114 being angled upward (or downward) to a greater degree.

In some embodiments, the frame 102 may include a number of connectors 112 that enable easy assembly and disassembly of the frame 102 and that can impart additional strength and stability to the frame 102. The connectors 112 may include one or more channels, each for receiving an end of a frame support. For example, connectors 112 illustrated in the embodiment of FIG. 1 each includes three channels—one for receiving an end of a lateral support 104, one for receiving an end of the rear bracing member 106, and one for receiving an end of an upper support 110. In this way, the three supports (lateral support 104, rear bracing member 106, and upper support 110) are connected together via a connector 112. Spring-loaded pins and corresponding pin apertures may be provided on/in the connectors 112 and frame supports to lock the frame supports to the connectors 112. Note that both the number and geometry of the connectors used in a frame will depend upon the desired geometry of the frame.

In some embodiments, the frame 102 may include additional components. For example, additional bracing members, reinforcement members 150, supports with attachment points for the net 114, and/or other components that provide strength, stability, and/or other characteristics to the training net 100 may be included on the frame 102. It will be appreciated that other frame designs may be utilized to mount the net 114 using an elastic member that extends along all or part of the bottom edge 142 of the net 114.

The frame 102 may be formed from various materials, such as metals (steel, aluminum, etc.), carbon fiber, fiberglass, plastics, and/or other synthetic material. It will be appreciated that in some embodiments rather than being a single piece of material, some or all of the components of the frame 102 may actually be multiple pieces of material that are coupled together. For example, some or all of the components may be designed similar to tent poles, with two or more sections joined by a mating receptacle and a separate elastic member. Additionally, while illustrated with most of the components of the frame 102 being straight rod-like members, in some embodiments, some or all of the components of the frame 102 may be bent and/or curved to meet the needs of a particular training application.

In some embodiments, the various pieces of the frame 102 may be connected to one another directly. For example, one or more of the supports and/or bracing members may include mating features that are used to secure the pieces of the frame 102 together. In other embodiments, the pieces of the frame 102 may be secured using one or more fasteners (such as nuts and bolts) and/or may be permanently secured to one another, such as via welding. In other embodiments, the various pieces of the frame 102 may be connected via one or more joint members that may have mating features that are usable to assemble the frame 102. In some embodiments, the frame 102 may be capable of being disassembled and packed into a smaller form factor for storage and/or transport.

The frame 102 provides a number of attachment points for attaching the net 114 (preferably, but not necessarily, for removably attaching the net 114) to the frame 102. In the case of a rectangular (or generally rectangular) net 114 having an top edge 144, bottom edge 142, and opposing side edges 143, attachment points may be provided on the distal ends of the upper supports 110 to couple opposing upper corners 124 of the net 114 with the frame 102. Attachment points may also be provided on the forwardmost end of each lateral support 104 to couple opposing lower corners 123 of the net 114 with the frame 102. Additional attachment points may be provided in other locations on the frame to couple medial portions of the net 114 to the frame 102.

Figure 2:
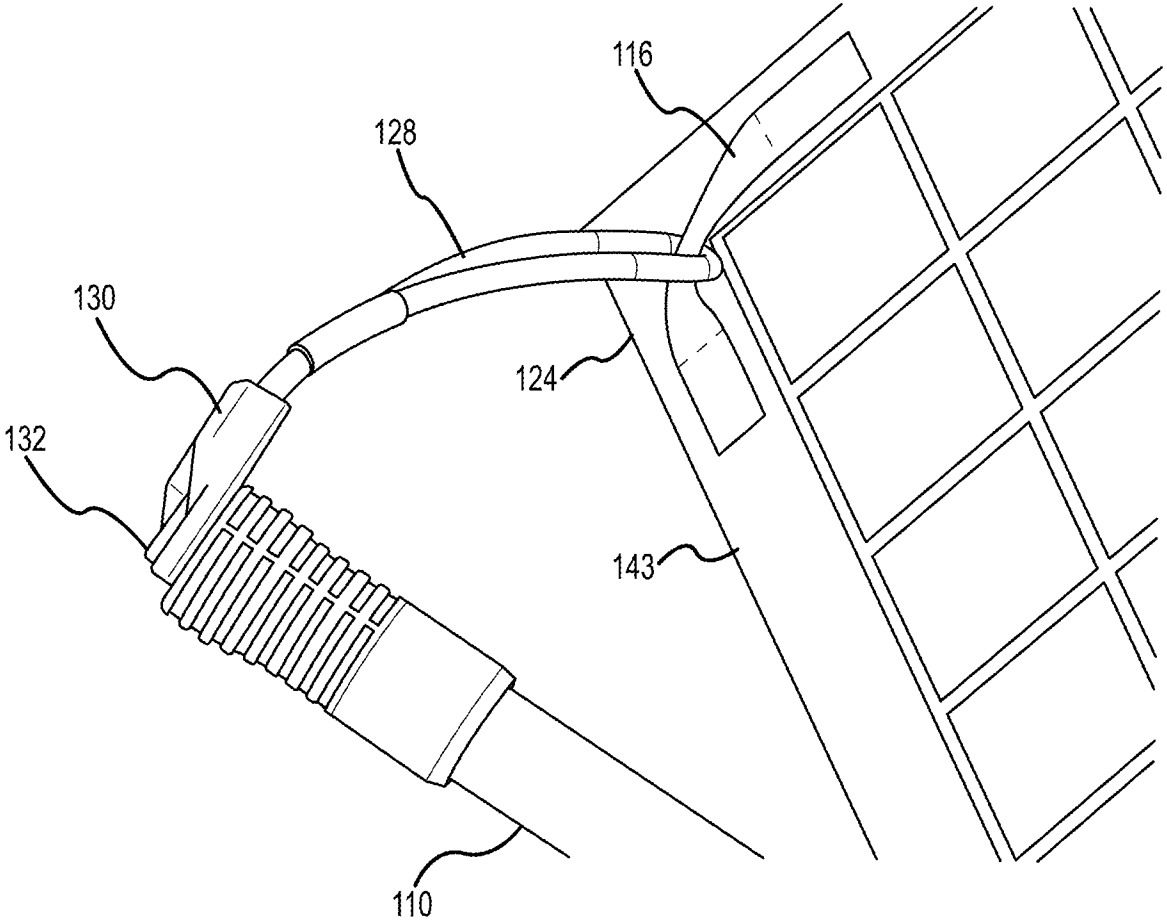
FIG. 2 illustrates an upper attachment loop of the soccer training net of FIG. 1.
Figure 3:
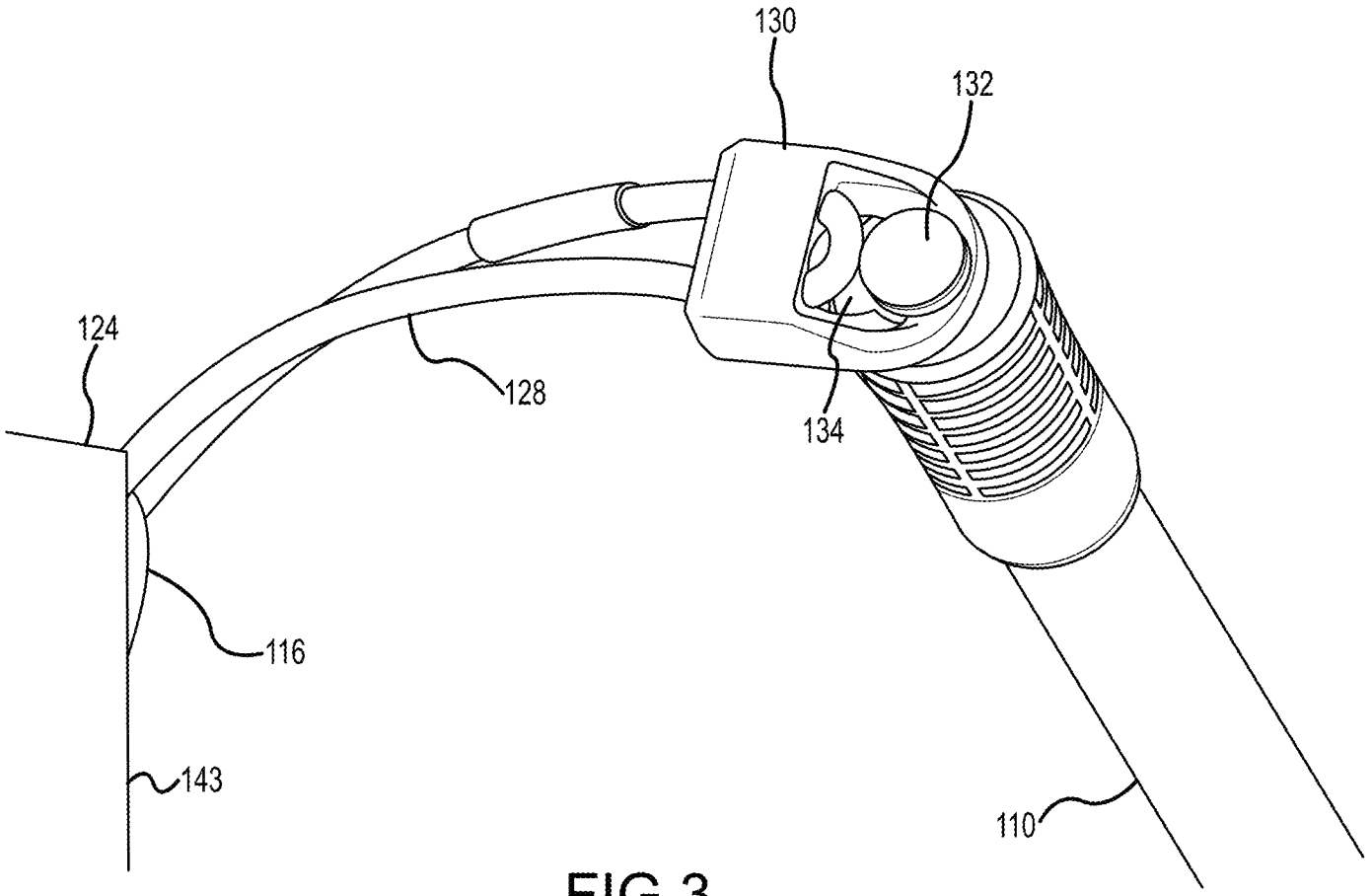
FIG. 3 illustrates a mating feature of an upper support of the soccer training net of FIG. 1.

The net 114 may be coupled with the various attachment points in various ways. Various attachment techniques are illustrated in FIGS. 2-5. For example, FIG. 2 depicts an attachment loop 116 provided on a rear surface of an upper corner 124 of net 114. A similar attachment loop 116 would be provided at the opposing upper corner 124 of net 114. The attachment loop 116 may be formed into a border or binding of the net 114 and/or may be later attached. As illustrated, the attachment loop 116 is formed from a length of webbing having end portions that have been stitched, adhered, and/or otherwise attached to the binding of the net 114. In other embodiments, the attachment loop 116 may be formed from a grommet and/or other component that is able to receive an elastic member 128. As shown here, the elastic member 128 may be looped through the attachment loop 116 so one end of the elastic member 128 is anchored to the attachment loop 116. As best illustrated in FIG. 3, the other end of the elastic member 128 may be secured to a connector 130. The connector 130 may be designed to quickly connect and/or disconnect the elastic member 128 (with attached net 114) to a corresponding mating feature 132 on the frame 102. For example, the mating feature 132 may be coupled with and/or formed integral with an end of the upper support 110. As illustrated, the connector 130 defines a keyhole slot 134 that is configured to receive a portion of a flanged protrusion that forms the mating feature 132. For example, a user may insert the mating feature 132 into a portion of the keyhole slot 134 having a larger diameter before sliding the mating feature 132 toward a smaller diameter portion of the keyhole slot 134 to secure the mating feature 132 with the connector 130. Oftentimes, the smaller diameter portion of the keyhole slot 134 is positioned further from the net 114 than the larger diameter portion. This ensures that when the net 114 is affixed to the frame 102, tension applied by the elastic member 128 helps maintain the mounting feature 132 in engagement with the smaller diameter portion of the keyhole slot 134 to help prevent the mating feature 132 from backing out of the connector 130.

In some embodiments, different connectors may be utilized. For example, snaps, clips, hook and loop fasteners, and/or other fastening mechanisms may be used to couple the elastic member 128 with the frame 102. It will be appreciated that in other embodiments, rather than including a connector 130 the elastic member 128 may be secured directly to the frame 102. For example, a loop of elastic member 128 may be wrapped at least partially around the mounting feature 132 to secure the net 114 to the frame 102. In some embodiments, the mounting structures of the connector 130 and mounting feature 132 may be reversed. For example, the mounting feature 132 may define a keyhole slot that is configured to receive a flanged protrusion of the connector 130.

Figure 4:
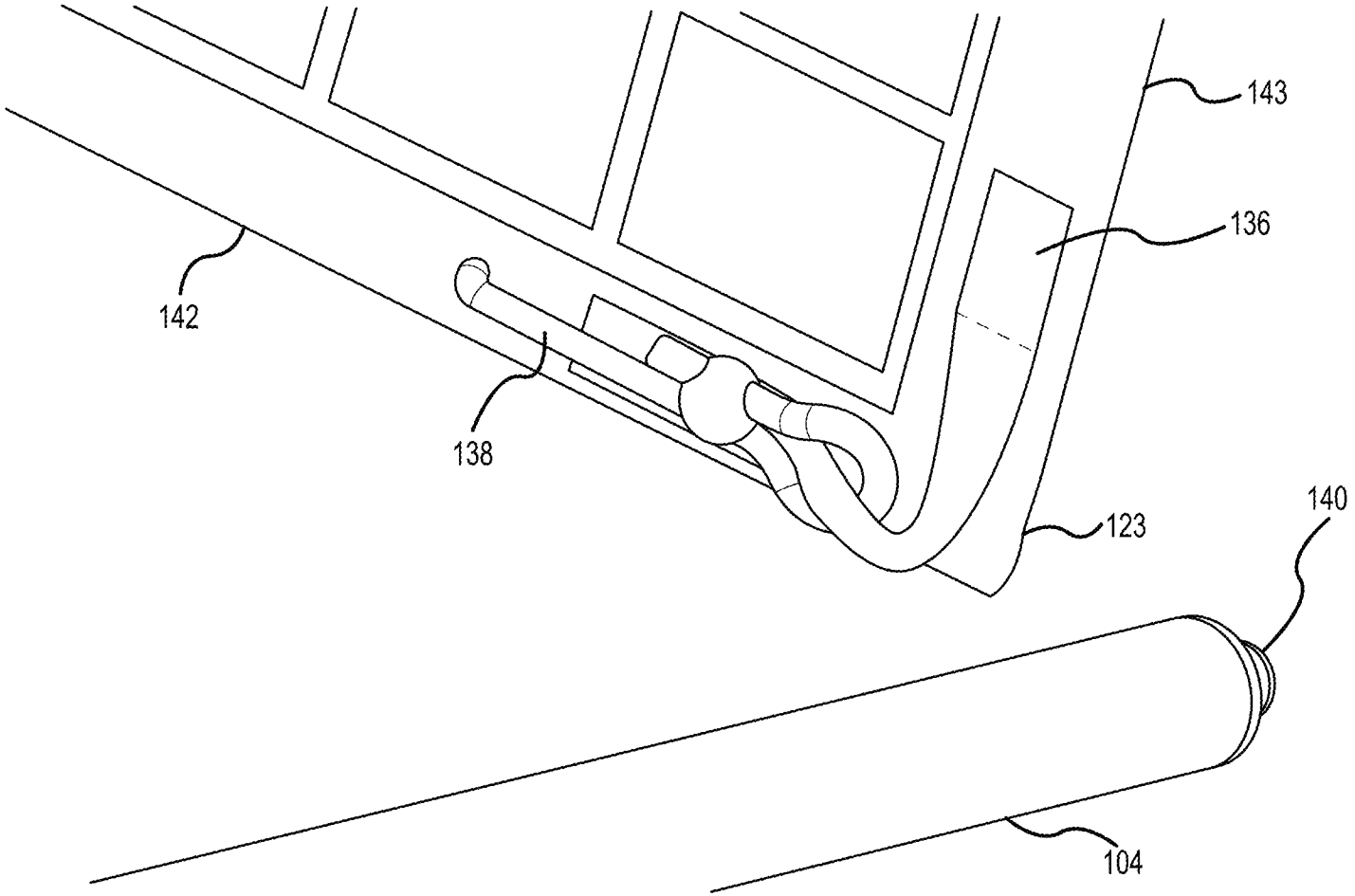
FIG. 4 illustrates a lower attachment loop of the soccer training net of FIG. 1.

FIG. 4 depicts another attachment loop 136 provided on rear surface of lower corner 123 of the net 114. A similar attachment loop 136 would be provided at the opposing lower corner 123 of the net 114. Similar to attachment loop 116, attachment loop 136 may be formed into a binding of the net 114 and/or may be later attached.

Unlike the discrete elastic members 128 shown in FIGS. 2 and 3 that can be used to secure the upper corners 124 of the net 114 to the frame 102, a lower elastic member 138 may be provided on the net 114 so as to extend along all or a substantial portion of the length of the bottom edge 142 of the net 114. In some embodiments, the bottom edge 142 of the net 114 may be formed with a channel or sleeve (not shown) that is configured to receive the medial portion of the lower elastic member 138. The channel or sleeve may be continuous and/or may be formed from a series of loops. For example, in some embodiments the sleeve may be formed by folding a piece of fabric (such as from 1-3 inches, although the size may vary) of the binding of the net 114 on its edge to create a channel to receive the lower elastic member 138 such that the medial portion of the lower elastic member 138 is housed within the sleeve while the opposing ends of the lower elastic member 138 are exposed for attachment (as described below). In other embodiments, the lower elastic member 138 may be coupled with the bottom edge 142 of the net 114 at a number of discrete locations, such as by using ties or clips.

Figure 5:
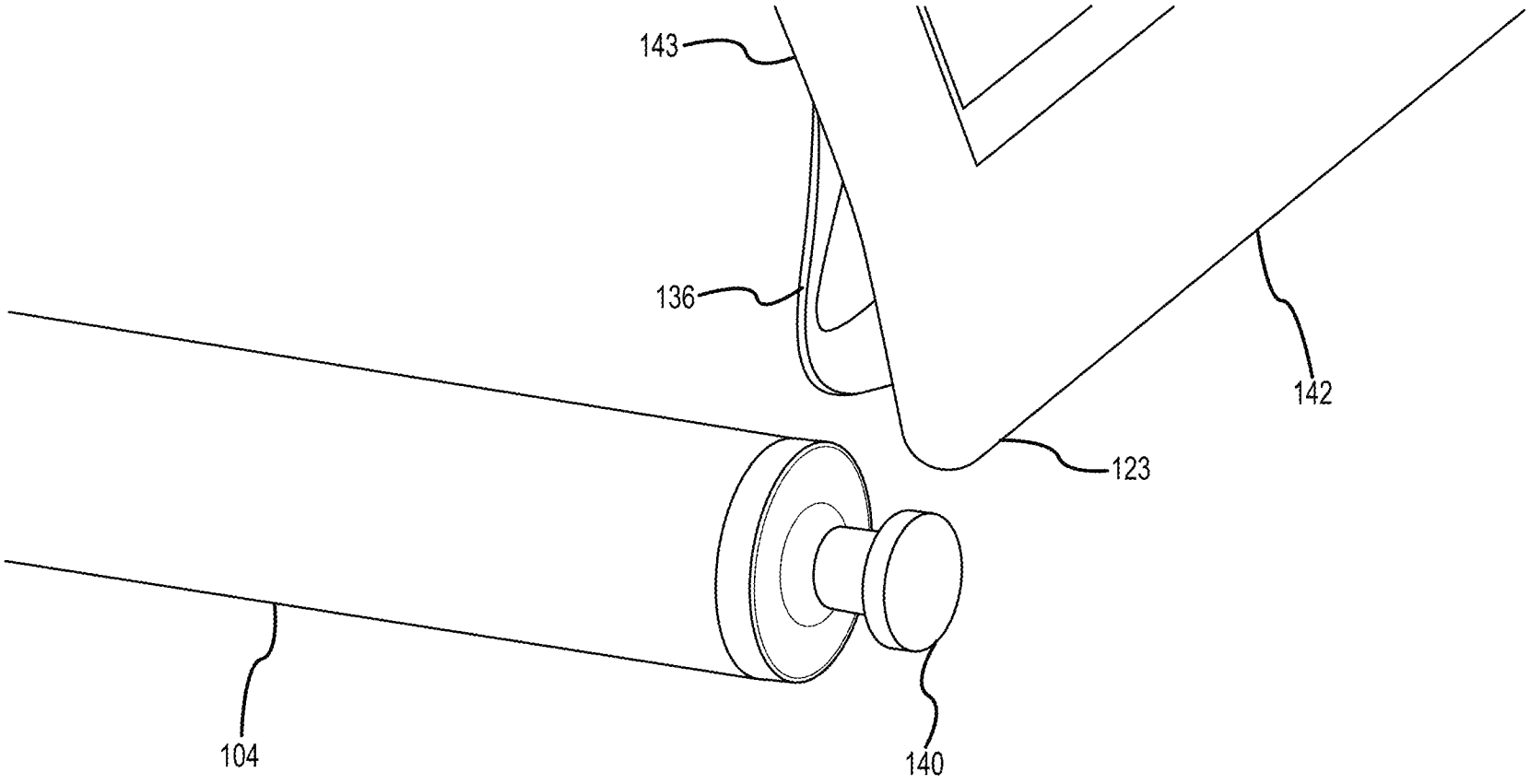
FIG. 5 illustrates a mating feature of a lower support of the soccer training net of FIG. 1.

Each end of the lower elastic member 138 may be looped around and/or otherwise secured to an attachment loop 136, while a medial portion of the lower elastic member 138 may extend along and be coupled with a bottom edge 142 of the net 114. As best illustrated in FIG. 5, an end of the lateral support 104 may include a mating feature 140, which may be coupled with and/or formed integral with an end of the lateral support 104. As illustrated, the mating feature 140 is in the form of a flanged protrusion. To couple the lower corners 123 of the net 114 to the frame 102, the attachment loop 136 may be at least partially wrapped around the mounting feature 140.

It will be appreciated that in some embodiments, rather than using the attachment loop 136 to couple the net 114 to the frame 102, a loop of the lower elastic member 138 may be wrapped at least partially around the mounting feature 132 to secure the net 114 to the frame 102. In other embodiments, each lower corner 123 of the net 114 may include a connector (such as a connector that is similar to connector 130) that is used to secure the net 114 to the frame 102. In some embodiments, such a connector may be coupled with the lower elastic member 138, the binding of the net 114, and/or the attachment loop 136. It will be appreciated that other techniques to secure the net 114 with the frame 102 may be utilized in accordance with the present invention. Additionally, while shown with different attachment mechanisms for the upper corners 124 and lower corners 123 of the net 114, in some embodiments, the same attachment mechanism may be used for all points of attachment of the net 114 and frame 102.

Turning back to FIG. 1, the net 114 is shown mounted to the frame 102. The lower elastic member 138 is coupled along all or a substantial portion of the length of the bottom edge 142 of the net 114. By attaching the lower elastic member 138 to the bottom edge 142 of the net 114 along all or a substantial portion of the length of the net 114, and by ensuring that the lower elastic member 138 is pulled tight when secured to the frame 102, the bottom edge 142 of the net 114 is pulled down toward the ground and eliminates the gap between the net and the ground while also increasing the amount of elasticity and bounce back delivered by the training net 100. Such attachment of the net 114 also eliminates the need for a frame member (such as a front bottom bar) that extends across the frame 102 proximate the bottom edge 142 of the net 114. As a result, some embodiments of the training net 100 do not include such a frame member, which results in more consistent rebounding.

While illustrated with the top edge 144 of the net 114 being coupled to frame 102 using elastic members 128 that extend between the upper corners 124 of the net 114 and the mounting features 132 of the upper support 110, it will be appreciated that in other embodiments the top edge 144 of the net 114 may be attached to the upper supports 110 in a manner similar to the lower elastic member 138. For example, an upper elastic member may be provided within a sleeve or channel formed along the upper edge 144 of the net 114 (or otherwise attached along the upper edge 144), with exposed ends of the upper elastic member being coupled to the mounting features 132 on the upper supports 110. In yet other embodiments, rather than, or in addition to, including a lower and/or upper elastic member that extends horizontally along the top edge 144 and/or bottom edge 142 of the net 114, the net 114 may include left and right elastic members that extend vertically along opposing side edges 143 of the net 114. In such embodiments, a lower end of each vertically oriented elastic member may be secured to an end of a corresponding lower support 104 while an upper end of the elastic member may be secured to an end of a corresponding upper support 110.

Additionally, while shown with the net 114 sloping upward to rebound balls in the air, in some embodiments the net 114 may be affixed to the frame 102 such that the net 114 has a downward slope to rebound balls on the ground. Additionally, while illustrated with the net 114 being generally flat, in some embodiments the net 114 may be mounted to the frame 102 in a manner that allows the net 114 to have a curved profile when viewed from the side of the training net 100.

Figure 6:
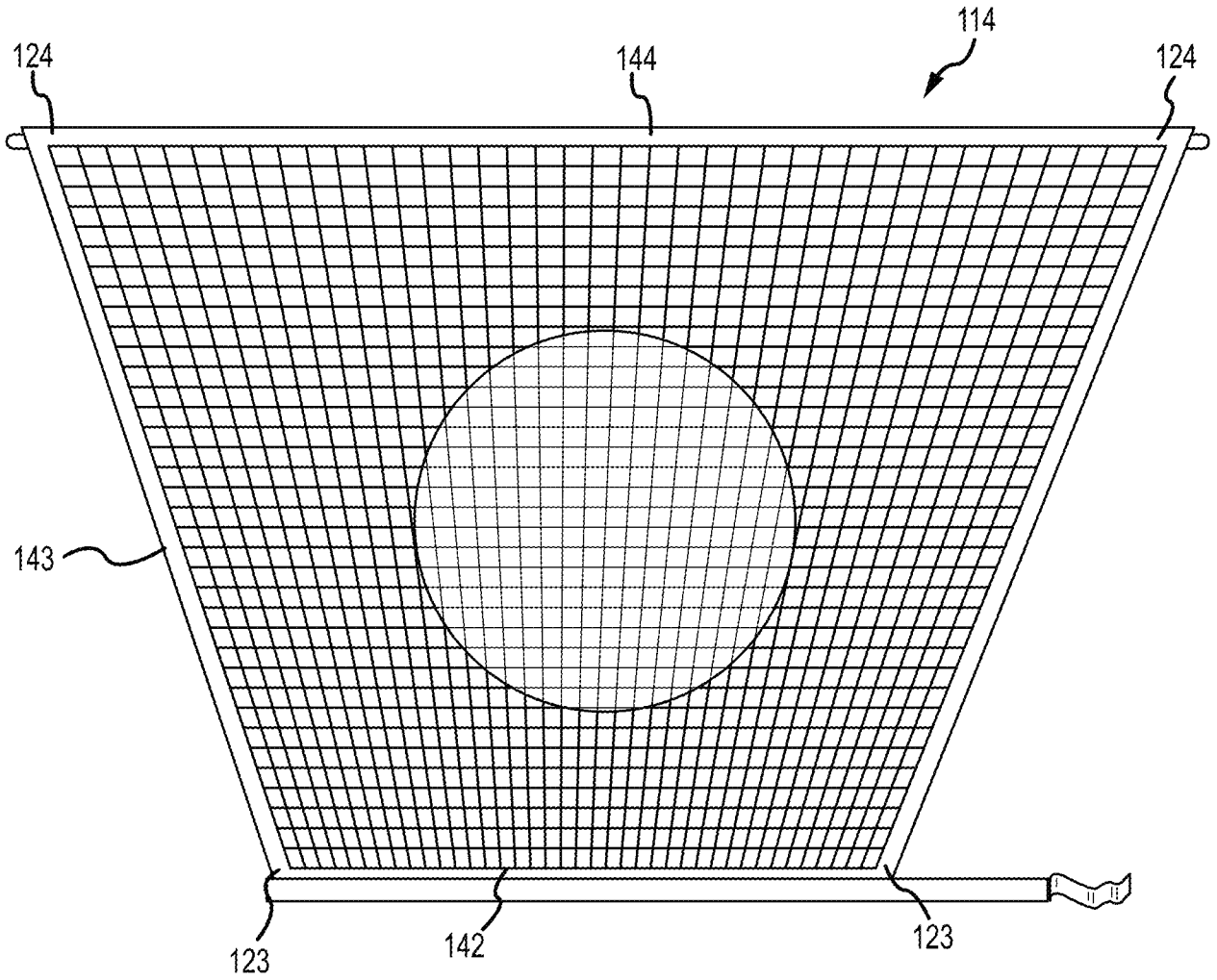
FIG. 6 illustrates a net that is unconstrained by a frame according to embodiments.

FIG. 6 illustrates the net 114 removed from the frame 102. Here, the lower elastic member 138 is received within a sleeve formed in the bottom edge 142 of the net 114. In this embodiment, when in an unstretched or equilibrium state, the lower elastic member 138 has a shorter length than the bottom edge 142 of the net 114. As a result, when not coupled to the frame 102, the lower elastic member 138 causes the bottom edge 142 of the net 114 to bunch up. By using a lower elastic member 138 that is shorter than the net 114, coupling the lower elastic member 138 to the frame 102 stretches the lower elastic member 138 to provide the desired amount of elasticity/rebound force. While illustrated with a generally rectangular net 114, it will be appreciated that net 114 may have other shapes. In such embodiments, the design of the frame 102 may be altered to properly support the net 114 with all or a substantial portion of a bottom edge being coupled with an elastic member to provide the desired rebounding force.

In some embodiments, the lower elastic member 138 (or other elastic members described herein) may be formed from multiple elastic members. In some embodiments, some or all of the elastic members may be coupled together. In other embodiments, the elastic members may be entirely separate. For example, two elastic members may be provided along the bottom edge 142 of the net 114 so that they collectively extend along all or a substantial portion of the bottom edge 142, with one end of each elastic member exposed and used to couple the net 114 to the frame 102, while the other end of each elastic member is secured to a medial portion of the bottom edge 142 of the net 114.

Figure 7:
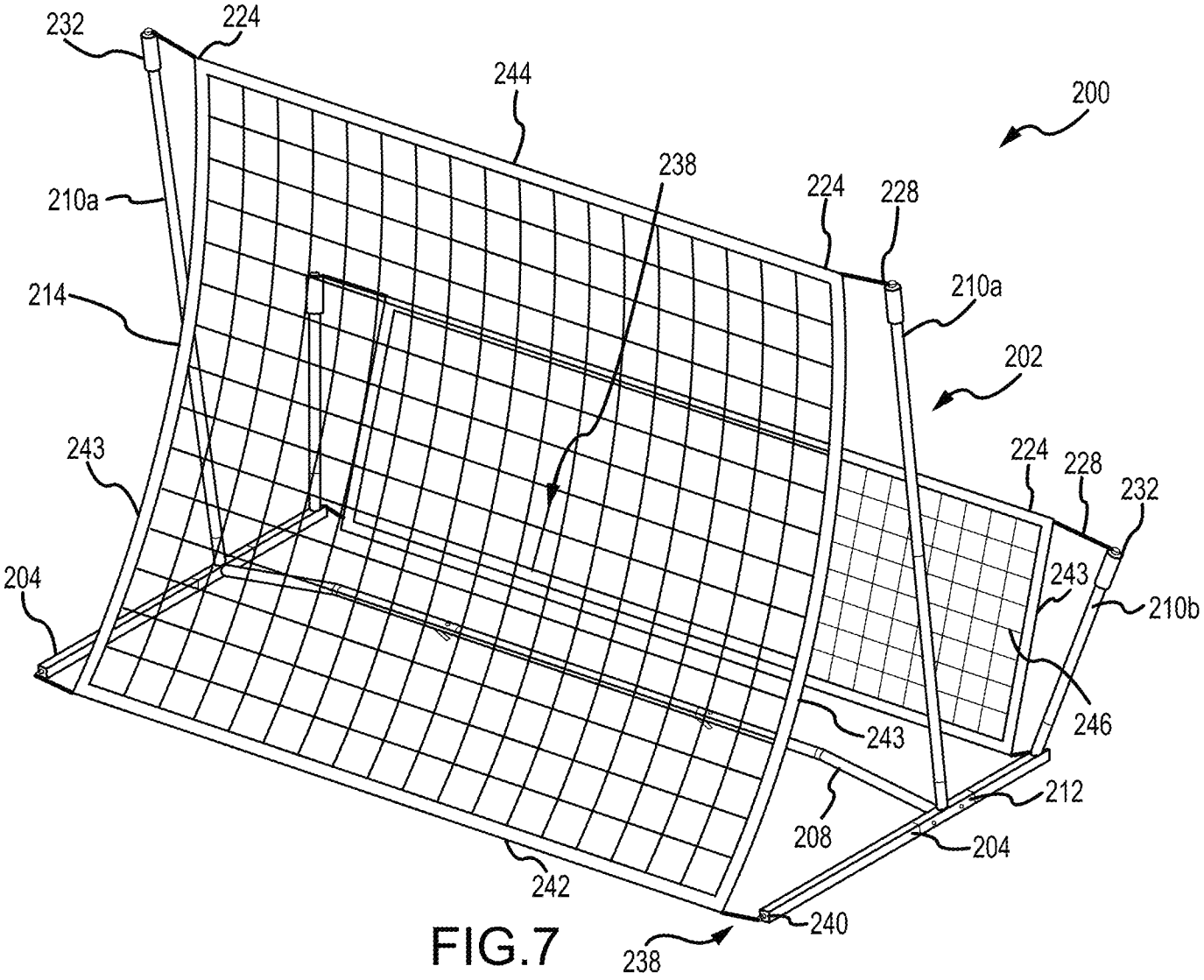
FIG. 7 illustrates a soccer training net having two nets according to embodiments.

FIG. 7 illustrates another embodiment of a training net 200. Here, training net 200 includes a frame 202 that supports a first net 214 and a second net 246. The first net 214 and second net 246 are supported on opposite sides of the frame 202 and may provide different training capabilities. For example, the first net 214 may be angled upward and may be designed to deliver rebounds in the air, allowing a user to practice receiving balls in the air. The second net 246 may be angled downward and may be designed to deliver rebounds on the ground, allowing a user to practice foot skills associated with passing, trapping, and shooting. In some embodiments, the first net 214 may be larger than the second net 246, while in other embodiments the sizes may be reversed or the nets 214, 246 may be the same size. Additionally, while shown here with two nets 214, 246 that provide different rebound effects (e.g., ground or aerial), it will be appreciated that in some embodiments the training net 200 may include two nets 214, 246 that provide the same rebound effects, allowing both sides of the training net 200 to be used simultaneously for the same training purpose.

As noted above, the two nets 214, 246 may be supported by frame 202, which may be similar to the frame 102 described above and may include any of the features described in relation to FIGS. 1-5. For example, the frame 202 may include a lower portion that includes a number of frame supports that provide a solid base for the nets 214, 246. For example, the frame 202 may include two or more lateral supports 204 that form sides of the lower portion of the frame 202. The lateral supports 204 may be coupled together via one or more bracing members. For example, as illustrated one or more medial bracing members 208 may extend between the lateral supports 204. For example, as shown in FIG. 7, one medial bracing member 208 is coupled with the lateral supports 104 to help prevent the lateral supports 204 from moving inward or outward relative to one another. While shown with two lateral supports 204 and one medial bracing member 208, it will be appreciated that other numbers and/or arrangements of supports and/or bracing members may be utilized to form a lower portion of a frame 202. However, as described in more detail below, the frame 202 can, but may not, include a front bracing member and/or a rear bracing member extending between the lateral supports proximate the bottom edges 242 of nets 214, 246.

The frame 202 may also include an upper portion that extends from the lower portion and that helps define an upper height of each of the nets 214, 246. The upper portion of the frame 202 may include at least one upper support 210 that extends upward from the lower portion of the frame 202. As illustrated, the frame 202 includes four upper supports 210. Upper supports 210*a* each extend upward from a medial portion of the lateral supports 204 to help support first net 214. As illustrated, the upper supports 210*a* may extend upward from the medial portion of each lateral support 204 (or other structure of the lower portion of the frame 202) at a generally perpendicular angle, however other angles may be possible. In the illustrated embodiment, connectors 212 (akin to connectors 112) provided along each lateral support 204 are used to connect each lateral support 204 to the medial bracing member 208 and its respective upper support 210*a*. The positioning of a forwardmost end of each upper support 210*a* relative to a forwardmost end of the lateral supports 204 may drive an angle of the net 214 once the first net 214 is coupled with the frame 202. For example, the less the horizontal distance is between the forwardmost ends of the lateral supports 204 and the upper supports 210*a*, the more vertical orientation the first net 214 will have relative to the ground, while greater forward or rearward horizontal distances result in the first net 214 being angled downwardly or upwardly to a greater degree.

Upper supports 210*b* each extend upward from a rear end portion of the lateral supports 204 to help support the second net 246. In some embodiments, the upper supports 210*b* may extend upward from rear end of each the lateral support 204 (or other structure of the lower portion of the frame 202) at an angle. For example, the upper supports 210*b* may project rearward from a rear portion of the lateral supports 204 such that an upper end of each upper support 210*b* points rearward and upward. The positioning of a rearmost end of each upper support 210*b* relative to a rearmost end of the lateral supports 204 may drive an angle of the second net 246 once the second net 246 is coupled with the frame 202. For example, the less the horizontal distance is between the rearmost ends of the lateral supports 204 and the upper supports 210*b*, the more vertical orientation the second net 246 will have relative to the ground, while greater forward or rearward horizontal distances result in the second net 246 being angled downwardly or upwardly to a greater degree.

In some embodiments, the frame 202 may include additional components. For example, additional bracing members, reinforcement members, supports with attachment points for the nets, and/or other components that provide strength, stability, and/or other characteristics to the training net 200. It will be appreciated that other frame designs may be utilized to mount the nets 214, 246.

The frame 202 provides a number of attachment points for the nets 214, 246. The attachment points enable the nets 214, 246 to be affixed to the frame 202 using one or more coupling mechanisms such as those described above in accordance with FIGS. 1-5. As just one example, the upper corners 224 of each net 214, 246 may be coupled with the frame 202 using an elastic member 228 that is coupled between a binding of the respective net 214, 246 and a mounting feature 232 on a respective upper support 210.

A lower elastic member 238 may extend along all or a substantial portion of the bottom edge 242 of each net 214, 246. The bottom edge 242 of the net 24 may be formed with a channel or sleeve (not shown) that is configured to receive the medial portion of the lower elastic member 138. In other embodiments, each lower elastic member 238 may be coupled with the bottom edge 242 of a respective net 214, 246 at a number of discrete locations, such as by using ties or clips. The lower elastic member 238 may have ends that can be looped around and/or otherwise secured to the binding of the respective net 214, 246 (such as using an attachment loop).

Opposing ends of each lateral support 204 may include a mating feature 240 that may be used to couple the elastic member 238 of each net 214, 246 (directly or via one or more intervening components) to the lateral support 204 to secure the net 214, 246 to the frame 202. By attaching the lower elastic member 238 to the bottom edge 142 of the net 114 along all or a substantial portion of the length of the net 114, and by ensuring that each lower elastic member 238 is pulled tight when secured to the frame 202, the bottom edge 242 of each net 214, 246 is pulled down toward the ground and eliminates the gap between the net and the ground while also increasing the amount of elasticity and bounce back delivered by the training net 200. Such attachment of the nets 214, 246 also eliminates the need for a frame member (such as a front or rear bottom bar) that extends across the frame 202 proximate the bottom edge 242 of the nets 214, 246. As a result, some embodiments of the training net 200 do not include such frame members, which results in more consistent rebounding.

While illustrated with the top edge 244 of the nets 214, 246 being coupled to frame 202 using elastic members 228 that extend between the corners of the respective net 214, 246 and the mounting features 232 of the upper supports 210, it will be appreciated that in other embodiments the top edge 244 of one or both nets 214, 246 may be attached to the upper supports 210 in a manner similar to the lower elastic member 238. In yet other embodiments, rather than, or in addition to, including a lower and/or upper elastic member that extends horizontally along the top edge 244 and/or bottom edge 242 of the respective net 214, 246, one or both of nets 214, 246 may include left and right elastic members that extend vertically along opposing side edges 243 of the nets 214, 246. In such embodiments, a lower end of each vertically oriented elastic member may be secured to an end of a corresponding lower support 204 while an upper end of the elastic member may be secured to an end of a corresponding upper support 210.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A soccer training rebounding net comprising:

a frame having an upper portion, a lower portion, a first lateral side, and a second lateral side;

a generally rectangular net having a bottom edge and a top edge, wherein the top edge comprises a first corner and a second corner opposite the first corner;

a lower elastic member comprising a first end, a second end, and a medial section that extends between the first end and the second end, wherein:

the medial section is coupled with and extends along the bottom edge of the net;

the first end is coupled with the first lateral side of the lower portion of the frame at a first attachment point; and the second end is coupled with the second lateral side of the lower portion of the frame at a second attachment point; and the lower elastic member is adapted to laterally tension the net to enhance the bounce back of the rebounding net when impacted by a ball;

a first upper coupling member that extends between and is coupled with the upper portion of the frame and the first corner of the top edge of the net; and a second upper coupling member that extends between and is coupled with the upper portion of the frame and the second corner of the top edge of the net, wherein:

the frame is devoid of a frame member that extends between the first lateral side and the second lateral side both immediately proximate the bottom edge of the net and immediately proximate the first and second attachment points such that the medial section of the lower elastic member and the bottom edge of the net are suspended between the first lateral side and the second lateral side of the lower portion of the frame.

2. The soccer training rebounding net of claim 1, wherein:

the bottom edge of the net defines a channel that receives the medial section of the lower elastic member.

3. The soccer training rebounding net of claim 1, wherein:

the lower elastic member has an unstretched length that is less than a length of the bottom edge of the net.

4. The soccer training rebounding net of claim 1, wherein:

each of the first end and the second end of the lower elastic member comprises a loop that is configured to couple with a corresponding attachment member on the lower portion of the frame at the first and second attachment points, respectively.

5. The soccer training rebounding net of claim 1, wherein:

the lower elastic member extends along substantially an entire length of the bottom edge of the net.

6. The soccer training rebounding net of claim 1, further comprising:

an additional net that is coupled with the frame using a plurality of elastic members.

7. The soccer training rebounding net of claim 6, wherein:

an outward facing surface of the additional net is angled downward.

8. A soccer training rebounding net comprising:

a frame having an upper net support and a lower net support;

a net having an outer periphery comprising a bottom edge and at least one upper attachment point;

a lower elastic member comprising a first end, a second end, and a medial portion that extends between the first end and the second end, wherein:

the medial portion is coupled with and extends along the bottom edge of the net;

the first end is coupled with a first portion of the lower net support at a first lower attachment point; and the second end is coupled with a second portion of the lower net support at a second lower attachment point;

the lower elastic member is adapted to laterally tension the net to enhance the bounce back of the rebounding net when impacted by a ball; and at least one upper coupling member extending between and being coupled with the upper net support and the at least one upper attachment point of the net, wherein:

the frame is devoid of a frame member that extends between opposing sides of the lower net support immediately proximate the first and second lower attachment points.

9. The soccer training rebounding net of claim 8, wherein:

the first end of the lower elastic member is coupled with the first portion of the lower net support via a first attachment loop; and the second end of the lower elastic member is coupled with a second portion of the lower net support via a second attachment loop.

10. The soccer training rebounding net of claim 9, wherein:

each of the first attachment loop and the second attachment loop are secured to a binding of the net.

11. The soccer training rebounding net of claim 8, wherein:

the at least one upper coupling member comprises an elastic member having a loop that extends between an end of the upper net support and the at least one upper attachment point of the net.

12. The soccer training rebounding net of claim 8, wherein:

the net is angled upward relative to a surface on which the lower net support of the frame sits.

13. The soccer training rebounding net of claim 8, wherein:

the at least one upper coupling member comprises a connector that is configured to couple with a corresponding mating feature of the upper net support.

14. The soccer training rebounding net of claim 13, wherein:

the corresponding mating feature comprises a flanged protrusion; and the connector defines a keyhole slot that is configured to receive and retain the flanged protrusion.

15. A soccer training rebounding net comprising:

a frame comprising:

a left upper support having a first end and an opposing second end;

a right upper support having a first end and an opposing second end;

a left lower support having a first end and an opposing second end;

a right lower support having a first end and an opposing second end; and at least one bracing member that extends between the left lower support and the right lower support;

a net having an outer periphery comprising:

a bottom edge;

an upper left attachment point; and an upper right attachment point;

a lower elastic member comprising a first end, a second end, and a medial portion that extends between the first end and the second end, wherein:

the medial portion is coupled with and extends along the bottom edge of the net;

the first end of the lower elastic member is coupled with the first end of the left lower support at a lower left attachment point;

the second end of the lower elastic member is coupled with the first end of the right lower support at a lower right attachment point;

the lower elastic member is adapted to laterally tension the net to enhance the bounce back of the rebounding net when impacted by a ball; and the frame is devoid of a frame member that extends between the left lower support and the right lower support immediately proximate the lower left attachment point and the lower right attachment point;

an upper left coupling member extending between and being coupled with the first end of the left upper support and the upper left attachment point; and an upper right coupling member extending between and being coupled with the first end of the right upper support and the upper right attachment point.

16. The soccer training rebounding net of claim 15, wherein:

the second end of the left upper support is coupled with the left lower support proximate the second end of the left lower support; and the second end of the right upper support is coupled with the right lower support proximate the second end of the right lower support.

17. The soccer training rebounding net of claim 15, wherein:

the second end of the left upper support is coupled with a medial portion of the left lower support; and the second end of the right upper support is coupled with a medial portion of the right lower support.

18. The soccer training rebounding net of claim 15, further comprising:

an additional left upper support;

an additional right upper support; and an additional net that is secured to the frame using attachment mating features on each of the additional left upper support, the additional right upper support, the left lower support, and the right lower support.

19. The soccer training rebounding net of claim 18, wherein:

one of the net or the additional net is angled downward relative to a surface on which the left lower support of the frame and the right lower support of the frame sit.

20. The soccer training rebounding net of claim 15, further comprising:

a first reinforcement member that is coupled between the left upper support and the left lower support; and a second reinforcement member that is coupled between the right upper support and the right lower support.

* * * * *